US012263915B1

(12) United States Patent
Koetsier et al.

(10) Patent No.: US 12,263,915 B1
(45) Date of Patent: Apr. 1, 2025

(54) ANCHORING SYSTEM FOR A MARINE VESSEL

(71) Applicant: Brunswick Corporation, Mettawa, IL (US)

(72) Inventors: Nathan D. Koetsier, Marne, MI (US); Samuel B. Carlisle, Caledonia, MI (US)

(73) Assignee: Brunswick Corporation, Mettawa, IL (US)

( * ) Notice: Subject to any disclaimer, the term of this patent is extended or adjusted under 35 U.S.C. 154(b) by 485 days.

(21) Appl. No.: 17/706,104

(22) Filed: Mar. 28, 2022

(51) Int. Cl.
*B63B 21/00* (2006.01)
*B63H 20/00* (2006.01)
*B63H 25/42* (2006.01)

(52) U.S. Cl.
CPC ..... *B63B 21/00* (2013.01); *B63H 20/007* (2013.01); *B63H 25/42* (2013.01); *B63B 2021/003* (2013.01)

(58) Field of Classification Search
CPC ... B63B 21/00; B63B 2021/003; B63H 20/00; B63H 20/007; B63H 25/00; B63H 25/42
USPC ..... 114/293
See application file for complete search history.

(56) References Cited

U.S. PATENT DOCUMENTS 5,088,943 A 2/1992 Henderson
5,386,368 A 1/1995 Knight
5,491,636 A 2/1996 Robertson et al.
5,525,081 A 6/1996 Mardesich et al.
5,884,213 A 3/1999 Carlson
6,041,730 A 3/2000 Oliverio et al.
6,273,771 B1 8/2001 Buckley et al.
6,377,515 B1 4/2002 Healey
6,667,934 B1 12/2003 Healey
6,678,589 B2 1/2004 Robertson et al.
6,870,794 B2 3/2005 Healey
6,885,919 B1 4/2005 Wyant et al.
6,902,446 B1 6/2005 Healey
7,305,928 B2 12/2007 Bradley et al.
8,478,464 B2 7/2013 Arbuckle et al.
9,290,256 B1 3/2016 Wireman et al.
9,335,412 B2 5/2016 Proctor
9,690,295 B1 6/2017 Abellera et al.
9,952,595 B2 4/2018 Arbuckle et al.
(Continued)

OTHER PUBLICATIONS

Lowrance, "HDS Carbon Integration—Controlling a Power Pole," YouTube video, Jun. 19, 2017, time 1:00-1:44, available at https://www.youtube.com/watch?v=klwXawdrVmM&t=98s.
(Continued)

*Primary Examiner* — Lars A Olson
(74) *Attorney, Agent, or Firm* — Andrus Intellectual Property Law, LLP

(57) ABSTRACT

A system for maintaining a marine vessel in place in a body of water includes a controller in signal communication with a power-deployable anchor and a propulsion-based electronic anchoring system and a user input device in signal communication with the controller. The controller deploys the power-deployable anchor in response to a single user-selected option input via the user input device under a first set of conditions. The controller activates the propulsion-based electronic anchoring system in response to the single user-selected option input via the user input device under a different second set of conditions.

20 Claims, 5 Drawing Sheets

(56) References Cited

U.S. PATENT DOCUMENTS

| | | | |
|---|---|---|---|
| 9,966,895 | B1 | 5/2018 | Deuel |
| 9,988,134 | B1 | 6/2018 | Gable et al. |
| 10,019,002 | B2 | 7/2018 | Harnett et al. |
| 10,095,232 | B1 | 10/2018 | Arbuckle et al. |
| 10,150,551 | B2 | 12/2018 | Steward et al. |
| 10,198,005 | B2 | 2/2019 | Arbuckle et al. |
| 10,324,468 | B2 | 6/2019 | Arbuckle et al. |
| 10,351,220 | B1 | 7/2019 | Witte et al. |
| 10,429,845 | B2 | 10/2019 | Arbuckle et al. |
| 10,633,072 | B1 | 4/2020 | Arbuckle et al. |
| 10,671,073 | B2 | 6/2020 | Arbuckle et al. |
| 10,745,096 | B2 | 8/2020 | Clark |
| 10,913,524 | B1 | 2/2021 | Wald et al. |
| 10,914,810 | B2 | 2/2021 | Laster et al. |
| 11,396,352 | B2 * | 7/2022 | Sirkin ..... B63B 21/16 |
| 2020/0249678 | A1 | 8/2020 | Arbuckle et al. |
| 2020/0250992 | A1 | 8/2020 | Derginer et al. |
| 2021/0165068 | A1 | 6/2021 | Clark |
| 2021/0255627 | A1 | 8/2021 | Snyder et al. |

OTHER PUBLICATIONS

Johnson Outdoors, "Shallow Water Anchor Buying Guide," admitted prior art, available at https://www.minnkotamotors.com/learn/buying-guide/shallow-water-anchors, last accessed Feb. 17, 2022.

* cited by examiner

ANCHORING SYSTEM FOR A MARINE VESSEL

FIELD

The present disclosure relates to marine vessels, and more specifically to marine vessels equipped with an anchor that can moor the marine vessel to the bottom of a body of water and also equipped with an electronic anchoring system.

BACKGROUND

U.S. Pat. No. 5,491,636 discloses an anchorless boat positioning system that dynamically and automatically maintains a boat at a selected anchoring location within water without the use of a conventional anchor by using a steerable thruster whose thrust and steering direction are determined on the basis of position information signals received from global positioning system (GPS) satellites and heading indication signals from a magnetic compass. The anchorless positioning system continuously monitors the position and heading of the boat and compares it with the stored coordinates of the selected anchoring location to generate control signals for the steerable motor.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,667,934 discloses a sonar system, and a digital sonar transducer for use with the system, in which transmitter and receiver circuitry are remote to the sonar display unit. In a preferred embodiment the digital sonar transducer includes: a housing; an acoustic transducer housed within the housing; transmitter circuitry for driving the acoustic transducer; receiver circuitry for conditioning received echos; and a computing device for receiving commands from a display unit, processing received echos, and sending echo information to the display unit. The display unit of the inventive system is configured to receive echo information from the digital sonar transducer and display sonar information to an operator.

U.S. Pat. No. 6,678,589 discloses an anchorless boat positioning system for establishing and maintaining a boat at a selected geographic location without the use of a conventional anchor. In one embodiment, a steerable thruster is used whose thrust and steering direction are determined and controlled on the basis of position information signals received from global positioning system (GPS) satellites, relative steering angle between the boat and the thruster and boat heading indication signals from a magnetic compass. The system continuously monitors the position and heading of the boat and compares it with the stored coordinates of the selected anchoring location(s) to generate control signals for the steerable motor. Several modes of operation are disclosed and Euler transformations for offset antenna placement for error reduction are taught. Proportional, integral, and derivative control (PID) of four constants of vessel control is also provided. Multiple thrusters in various arrangements are also provided to control either the orientation of the boat or a second point of interest on the boat at a second geographic location.

U.S. Pat. No. 7,305,928, discloses a vessel positioning system that maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 8,478,464 discloses systems and methods for orienting a marine vessel to enhance available thrust in a station keeping mode. A control device having a memory and a programmable circuit is programmed to control operation of a plurality of marine propulsion devices to maintain orientation of a marine vessel in a selected global position. The control device is programmed to calculate a direction of a resultant thrust vector associated with the plurality of marine propulsion devices that is necessary to maintain the vessel in the selected global position. The control device is programmed to control operation of the plurality of marine propulsion devices to change the actual heading of the marine vessel to align the actual heading with the thrust vector.

U.S. Pat. No. 9,335,412 discloses a sonar transducer assembly configured for imaging of an underwater environment. The sonar transducer assembly includes at least one transmit-only transducer element positioned within a housing and aimed outwardly and downwardly. The at least one transmit-only transducer element is configured to transmit sonar pulses to insonify a first volume. The sonar transducer assembly further includes at least one receive-only transducer element positioned within the housing and aimed outwardly and downwardly. The at least one receive-only transducer element is configured to receive sonar returns from the sonar pulses within a second volume. The second volume is smaller than the first volume and aimed so as to be wholly contained within the first volume. The housing is mountable to the water craft so as to enable rotation of the transducer elements with respect to the water craft. Corresponding systems and methods are also provided.

U.S. Pat. No. 9,988,134 discloses systems and methods for controlling movement of a marine vessel extending along a longitudinal axis between a bow and a stern and along a lateral axis between a port side and a starboard side, having a first propulsion device located closer to the stern than to the bow and steerable about a first steering axis perpendicular to the longitudinal and lateral axes, a second propulsion device located closer to the bow than to the stern and steerable about a second steering axis perpendicular to the longitudinal and lateral axes. An input device is configured to input a request for movement of the marine vessel. A control module is configured to control steering and thrust of the first and second propulsion devices to achieve a resultant movement of the marine vessel commensurate with the request for movement.

U.S. Pat. No. 10,019,002 discloses many different types of systems that are utilized or tasks that are performed in a marine environment. Various configurations of unmanned vehicles, or drones, that can be operated and/or controlled for such systems or tasks. One or more unmanned vehicles can be integrated with a dedicated marine electronic device of a marine vessel for autonomous control and operation. Additionally or alternatively, the unmanned vehicle can be manually remote operated during use in the marine environment. Such unmanned vehicles can be utilized in many different marine environment systems or tasks, including, for example, navigation, sonar, radar, search and rescue, video streaming, alert functionality, among many others. However, the marine environment provides many unique challenges that may be accounted for with operation and control of an unmanned vehicle.

U.S. Pat. No. 10,150,551 discloses a wind sensor, such as a sonic anemometer, that may be utilized to cause a trolling motor to activate to propel a watercraft toward a virtual anchor location, route, or destination, in response to detection of an occurrence or wind. In some instances, the trolling motor may be steered to a direction opposite a wind direction when activated. The trolling motor may also be oriented to a corrective direction based on a comparison of a current location to the virtual anchor location, route, or destination. Propelling the watercraft may also include determining a propulsion correction based on wind speed, wind direction, and/or watercraft characteristics. Depending on the configuration, the wind sensor may be integrated into the housing of the trolling motor.

U.S. Pat. No. 10,671,073 discloses a method for maintaining a marine vessel at a global position and/or heading, including receiving measurements related to vessel attitude and estimating water roughness conditions based on the measurements. A difference between the vessel's actual global position and the target global position and/or a difference between the vessel's actual heading and the target heading are determined. The method includes calculating a desired linear velocity based on the position difference and/or a desired rotational velocity based on the heading difference. The vessel's actual linear velocity and/or actual rotational velocity are filtered based on the roughness conditions. The method includes determining a difference between the desired linear velocity and the filtered actual linear velocity and/or a difference between the desired rotational velocity and the filtered actual rotational velocity. The method also includes calculating vessel movements that will minimize the linear velocity difference and/or rotational velocity difference and carrying out the calculated movements.

U.S. Pat. No. 10,914,810 discloses an apparatus for providing marine information, including a user interface, a processor, and a memory including computer program code. The memory and the computer program code are configured to, with the processor, cause the apparatus to generate a sonar image based on sonar return data received from an underwater environment, determine a location associated with the sonar return data based on location data received from one or more position sensors, and render a nautical chart on a display. The computer program code is further configured to cause the apparatus to receive a user input on the user interface directed to a portion of the display in which the nautical chart is presented, and modify presentation of the nautical chart such that the portion of the display presents the sonar image in response to receiving the user input.

The above patents are hereby incorporated by reference herein in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a system for a marine vessel comprises a power-deployable anchor that, when deployed, is configured to contact a bed of a body of water in which the marine vessel is located. The system includes an electronic anchoring system comprising a propulsion unit configured to produce thrust automatically when required to maintain the marine vessel at a target location in the body of water. The system also includes a user input device and a controller in signal communication with the user input device, the power-deployable anchor, and the electronic anchoring system. The controller is configured to deploy the power-deployable anchor to moor the marine vessel to the bed of the body of water in response to a single user-selected option input via the user input device under a first set of conditions. The controller is configured to activate the electronic anchoring system to maintain the marine vessel at the target location in the body of water in response to the single user-selected option input via the user input device under a different second set of conditions.

In one example, the controller is configured to activate the electronic anchoring system and to deploy the power-deployable anchor in response to the single user-selected option input via the user input device under a different third set of conditions.

In another example, at least one of the first and second sets of conditions includes information related to a location of the marine vessel with respect to Earth's geographical coordinate system and/or information related to a location of the marine vessel with respect to an object proximate to the marine vessel.

In another example, at least one of the first and second sets of conditions includes information related to the bed of the body of water.

In another example, at least one of the first and second sets of conditions includes information related to a depth of the body of water.

In another example, at least one of the first and second sets of conditions includes information related to at least one of wind, current, and weather conditions acting on the marine vessel.

In another example, at least one of the first and second sets of conditions includes information related to a speed of the marine vessel upon receipt of the single user-selected option.

In one example, the user input device is configured to accept further user-selectable options that allow the user to choose to deploy the power-deployable anchor or to activate the electronic anchoring system.

In one example, the electronic anchoring system comprises a sensor configured to determine an actual location of the marine vessel and an additional controller configured to determine marine vessel movements that will minimize a difference between the actual location of the marine vessel and the target location of the marine vessel. The additional controller is configured to control the thrust of the propulsion unit to carry out the determined marine vessel movements.

In one example, the power-deployable anchor comprises an actuator and an anchoring portion, the actuator being configured to deploy the anchoring portion into the bed of the body of water.

In one particular example, the controller is part of a fishfinder and/or chartplotter provided on the marine vessel, and the system further comprises a position sensor providing information related to at least one of the first and second sets of conditions to the fishfinder and/or chartplotter, and a sonar transducer providing information related to at least one of the first and second sets of conditions to the fishfinder and/or chartplotter.

According to another example of the present disclosure, a system for maintaining a marine vessel in place in a body of water comprises a controller in signal communication with a power-deployable anchor and a propulsion-based electronic anchoring system, and a user input device in signal communication with the controller. The controller is configured to deploy the power-deployable anchor in response to a single user-selected option input via the user input device under a first set of conditions. The controller is configured to activate the propulsion-based electronic anchoring system in response to the single user-selected option input via the user input device under a different second set of conditions.

In one example, the controller is configured to activate the electronic anchoring system and to deploy the power-deployable anchor in response to the single user-selected option input via the user input device under a different third set of conditions.

In one example, at least one of the first, second, and third sets of conditions includes at least one of the following: information related to a location of the marine vessel with respect to Earth's geographical coordinate system; information related to a location of the marine vessel with respect to an object proximate to the marine vessel; information related to a bed of the body of water; information related to a depth of the body of water; information related to at least one of wind, current, and weather conditions acting on the marine vessel; and information related to a speed of the marine vessel upon receipt of the single user-selected option.

In one example, the user input device is configured to accept further user-selectable options that allow the user to choose to deploy the power-deployable anchor or to activate the electronic anchoring system.

In one example, the electronic anchoring system comprises a sensor configured to determine an actual location of the marine vessel; an additional controller configured to determine marine vessel movements that will minimize a difference between the actual location of the marine vessel and a target location of the marine vessel; and a propulsion unit configured to produce thrust. The additional controller is configured to control the thrust of the propulsion unit to carry out the determined marine vessel movements.

In one example, the power-deployable anchor comprises an actuator and an anchoring portion, the actuator being configured to deploy the anchoring portion into a bed of the body of water.

In one particular example, the controller is part of a fishfinder and/or chartplotter provided on the marine vessel, and the system further comprises a position sensor providing information related to at least one of the first and second sets of conditions to the fishfinder and/or chartplotter, and a sonar transducer providing information related to at least one of the first and second sets of conditions to the fishfinder and/or chartplotter.

According to another example of the present disclosure, a system for a marine vessel comprises a power-deployable anchor that, when deployed, is configured to contact a bed of a body of water in which the marine vessel is located. The system includes an electronic anchoring system comprising a propulsion unit configured to produce thrust automatically when required to maintain the marine vessel at a target location in the body of water. The system includes a global positioning system (GPS) receiver. The system also includes a sonar depth finder. The system includes a fishfinder and/or chartplotter communicatively coupled to the power-deployable anchor, the electronic anchoring system, the GPS receiver, and the sonar depth finder. Given a first set of information from the GPS receiver and/or the sonar depth finder, the fishfinder and/or chartplotter is configured to deploy the power-deployable anchor to moor the marine vessel to the bed of the body of water in response to a command to maintain the marine vessel in place in the body of water. Given a different second set of information from the GPS receiver and/or the sonar depth finder, the fishfinder and/or chartplotter is configured to activate the electronic anchoring system to maintain the marine vessel at the target location in the body of water in response to the command to maintain the marine vessel in place in the body of water.

In one example, given a different third set of information from the GPS receiver and/or the sonar depth finder, the fishfinder and/or chartplotter is configured to activate the electronic anchoring system and to deploy the power-deployable anchor in response to the command to maintain the marine vessel in place in the body of water.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
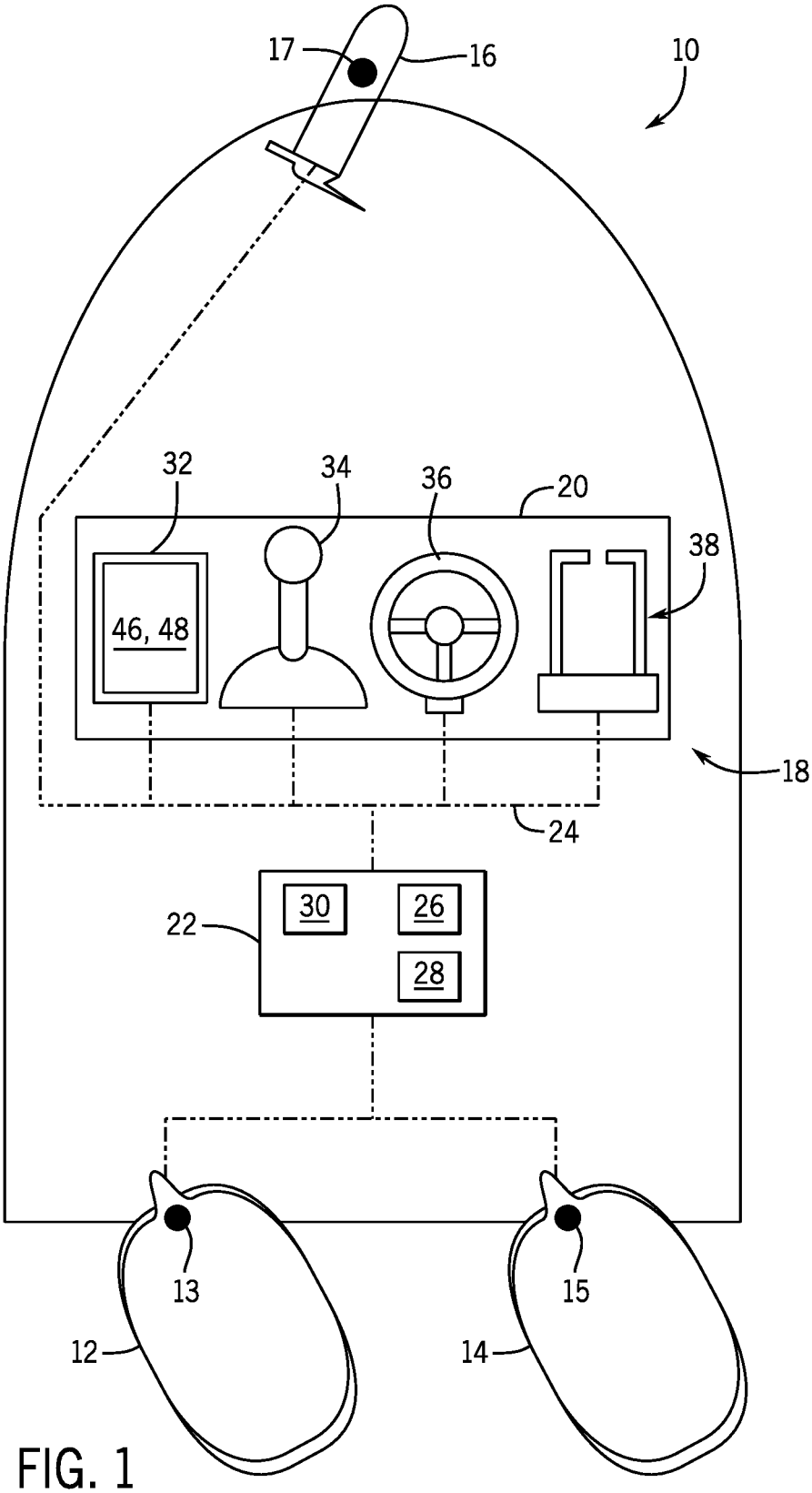
FIG. 1 illustrates a marine vessel equipped with several propulsion units.

FIG. 1 shows a marine vessel 10. The marine vessel 10 is capable of operating, for example, in a normal operating mode and an electronic anchoring mode among other modes, as described in U.S. Pat. No. 10,671,073, incorporated by reference above. The marine vessel 10 has first and second propulsion units 12, 14 located at its stern and a third propulsion unit 16 located at its bow. As illustrated, the first and second propulsion units 12, 14 are outboard motors and the third propulsion unit 16 is a trolling motor. However, each propulsion unit 12, 14, 16 could be any one of an inboard motor, a stern drive, a pod drive, an outboard motor, a trolling motor, a jet drive, a thruster, or any other marine propulsion unit, as appropriate for its location. Each propulsion unit is steerable about its respective steering axis 13, 15, 17 and produces thrust by causing rotation of its respective propeller or other propulsor, as the case may be.

The marine vessel 10 also includes various control elements that make up a marine propulsion system 18. The marine propulsion system 18 comprises an operation console 20 in communication with a controller 22 via a controller area network (CAN) bus 24 as described in U.S. Pat. No. 6,273,771. The controller 22 includes a processing system 26, a storage system 28 accessible by the processing system 26, and an input/output (I/O) interface 30, which relays information to and from the processing system 26. The processing system 26 can comprise a microprocessor, including a control unit and a processing unit, and other circuitry, such as semiconductor hardware logic, that retrieves and executes software from the storage system 28. The storage system 28 can comprise any storage media readable by the processing system 26 and capable of storing software. The storage system 28 can include volatile and non-volatile, removable and non-removable media implemented in any method or technology for storage of information, such as computer-readable instructions, data structures, software modules, or other data. The processing system 26 loads and executes software from the storage system 28, such as software programmed with an electronic anchoring algorithm, which directs the processing system 26 to operate as described herein below in further detail. In one example, the controller 22 is (or is part of) a helm control module, an engine control module, or other known module for use on a marine vessel 10. Note that the controller 22 is not shown as being connected to every component in the diagrams provided herein, but the controller 22 is in fact directly or indirectly electrically and/or signally connected to each component that it is described as controlling or from which it receives information.

The operation console 20 includes a number of user input devices, such as a marine electronic device 32 (to be described further herein below), a joystick 34, a steering wheel 36, and one or more shift/speed levers 38. Each of these user input devices may provide a request for movement of the marine vessel 10 to the controller 22 via the I/O interface 30. The steering wheel 36 and the shift/speed levers 38 function in the conventional manner. For example, rotation of the steering wheel 36 may activate a transducer that provides a signal to the controller 22 regarding a desired movement of the marine vessel 10. The controller 22 in turn sends signals to activate steering actuators to achieve desired orientations of the first and second propulsion units 12, 14 about their respective steering axes 13, 15 as known in the art. The shift/speed levers 38 send signals to the controller 22 regarding the desired shift or direction of movement (forward, reverse, or neutral) and the desired thrust for each of the first and second propulsion units 12, 14. The controller 22 in turn sends signals to activate actuators for shift or direction and for engine throttle or motor speed, respectively. As is known, the joystick 34 can also be used to input requests for movement to the controller 22, such as when the operator desires more controlled movement of the marine vessel 10, such as for example purely longitudinal movement, purely lateral movement, purely rotational movement, or any combination thereof, as is known in the art.

The third propulsion unit 16 can be controlled by the controller 22 as well, in response to inputs to the joystick 34, steering wheel 36, and shift/speed levers 38, as described in U.S. Pat. No. 9,988,134. Additionally or alternatively, the third propulsion unit 16 can be controlled by its own controller, such as one located in the head or base of the third propulsion unit 16 in the instance in which the third propulsion unit 16 is a trolling motor. In this way, the third propulsion unit 16 can be operated independently of the inputs to the joystick 34, steering wheel 36, and shift/speed levers 38. Those having ordinary skill in the art would understand that such control could be accomplished via inputs to a user interface on the head or base of the trolling motor and/or via inputs to a remote controller dedicated to controlling the trolling motor. Further, the marine electronic device 32 could also be used to provide inputs to the trolling motor controller, as is known.

It should be recognized that other inputs may be incorporated in addition to, or instead of, those described in the above embodiment. For example, inputs may come from other physical devices or from non-human sources, such as from electronic anchoring, waypoint tracking, or heading control systems. Similarly, the control functions described in conjunction with controller 22 may be distributed across multiple controllers, such as separate controllers within the first, second, and third propulsion units 12, 14, 16 or located elsewhere on the marine vessel 10.

Figure 2:
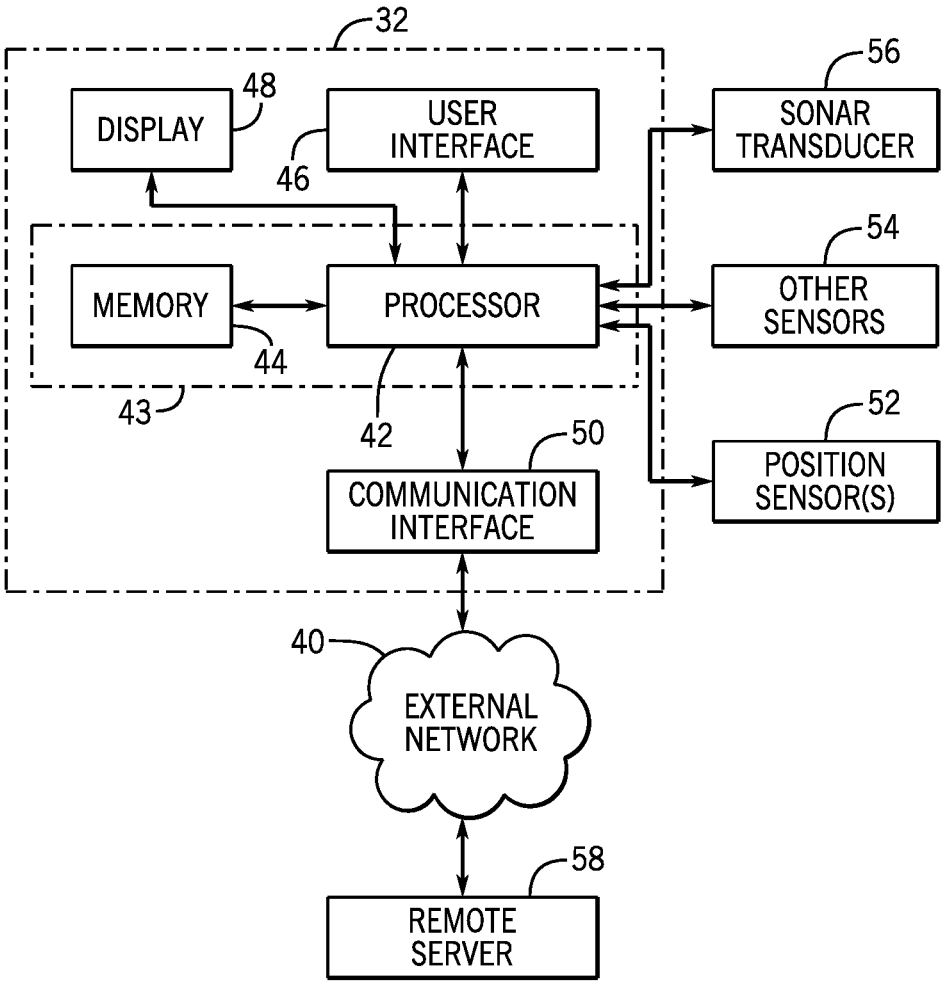
FIG. 2 is a block diagram of an example marine electronic system.

FIG. 2 shows a block diagram of an example of marine electronic device 32 as depicted in FIG. 1, as part of a marine data system. The marine electronic device 32 may include a number of different modules or components, each of which may comprise any device or means embodied in either hardware, software, or a combination of hardware and software configured to perform one or more corresponding functions. The marine electronic device 32 may also be in communication with an external network 40.

The marine electronic device 32 may include a processor 42 and a memory 44 (which may together be part of a controller 43), a user interface 46, a display 48, and a communication interface 50. Additionally, the marine electronic device 32 may include or otherwise be in communication with one or more sensors (e.g. position sensor(s) 52, other sensors 54, etc.) and/or one or more sonar transducers 56.

The processor 42 may be any means configured to execute various programmed operations or instructions stored in a memory device such as a device or circuitry operating in accordance with software or otherwise embodied in hardware or a combination of hardware and software (e.g., a processor operating under software control or the processor embodied as an application specific integrated circuit or field programmable gate array specifically configured to perform the operations described herein, or a combination thereof) thereby configuring the device or circuitry to perform the corresponding functions of the processor 42 as described herein. In this regard, the processor 42 may be configured to analyze electrical signals communicated thereto to provide or receive sonar data, sensor data, location data, and/or additional environmental data. For example, the processor 42 may be configured to receive sonar return data, generate sonar image data, and generate one or more sonar images based on the sonar image data. Additionally, the processor 42 may be configured to present a nautical chart correlated to the sonar images and/or shift/modify the perspective of the sonar image and nautical chart in response to a user input.

In some embodiments, the processor 42 may be further configured to implement signal processing or enhancement features to improve the display characteristics or data or images, collect or process additional data, such as time, temperature, GPS information, etc., or to filter extraneous data to better analyze the collected data.

In an example embodiment, the memory 44 may include one or more non-transitory storage or memory devices such as, for example, volatile and/or non-volatile memory that may be either fixed or removable. The memory 44 may be configured to store instructions, computer program code, marine data (such as sonar data, chart data, location/position data), and other data associated with the navigation system in a non-transitory computer readable medium for use, such as by the processor 42, for enabling the marine electronic device 32 to carry out various functions in accordance with example embodiments of the present disclosure. For example, the memory 44 could be configured to buffer input data for processing by the processor 42. Additionally or alternatively, the memory 44 could be configured to store instructions for execution by the processor 42.

The marine electronic device 32 may include one or more communications modules configured to communicate with one another in any of a number of different manners including, for example, via a network. In this regard, the communications module may include any of a number of different communication backbones or frameworks including, for example, Ethernet, the NMEA 2000 framework, GPS, cellular, WiFi, or other suitable networks. In one example, a communication interface 50 may be configured to enable connection to external systems (e.g., an external network 40). In this manner, the marine electronic device 32 may retrieve stored data from a remote server 58 via the external network 40 in addition to or as an alternative to the onboard memory 44. Additionally or alternatively, the marine electronic device 32 may transmit or receive data, such as sonar signals, sonar returns, sonar image data or the like to or from a sonar transducer 56. The marine electronic device 32 may also be configured to communicate with one or more of the propulsion units 12, 14, 16, such as via the CAN bus 24. The marine electronic device 32 may receive data indicative of operation of the propulsion units 12, 14, 16, such as propulsion unit running, running speed, or the like.

The position sensor(s) 52 may be configured to determine the current location and/or orientation of the marine vessel 10. For example, the position sensor(s) 52 may comprise a GPS receiver, a compass, a bottom contour sensor, an inertial navigation system such as a MEMS magnetic field sensor, a ring laser gyroscope, or other location detection system. In another example, the position sensor(s) 52 are distance and directional sensors. For example, the position sensor(s) 52 could be radars, sonars, cameras, lasers, Doppler direction finders, or other devices individually capable of determining both the direction and distance of an external object near the marine vessel 10, such as a dock, seawall, slip, large rock or tree, etc. Alternatively, separate sensors could be provided for sensing direction than are provided for sensing distance.

The display 48, e.g. screen, may be configured to display images and may include or otherwise be in communication with a user interface 46 configured to receive input from a user. The display 48 may be, for example, a conventional liquid crystal display (LCD), a touch screen display (as shown in FIG. 1), a mobile device display, or any other suitable display known in the art upon which images may be displayed.

In any of the embodiments, the display 48 may present one or more sets of marine data or images generated from the one or more sets of marine data. Such marine data includes chart data, radar data, weather data, location data, location data, orientation data, sonar data, or any other type of information relevant to the marine vessel 10. In some embodiments, the display 48 may be configured to present such marine data simultaneously as one or more layers or in split-screen mode. In some embodiments, a user may select any of the possible combinations of the marine data for display.

In some further embodiments, various sets of data, referred to above, may be superimposed or overlaid onto one another. For example, a route may be applied to (or overlaid onto) a chart (e.g., a map or navigational chart). Additionally or alternatively, depth information, weather information, radar information, sonar information, or any other navigation system inputs may be applied to one another.

The user interface 46 may include, for example, a keyboard, keypad, function keys, mouse, scrolling device, input/output ports, touch screen displaying soft keys, or any other mechanism by which a user may interface with the system.

Although the display 48 of FIG. 2 is shown as being directly connected to the processor 42 and within the marine electronic device 32, the display 48 could alternatively be remote from the processor 42 and/or marine electronic device 32. Likewise, in some embodiments, the user interface 46 could be remote from the marine electronic device 32.

The marine electronic device 32 may include one or more other sensors 54 configured to measure environmental conditions. The other sensors 54 may include, for example, an air temperature sensor, a water temperature sensor, a current sensor, a light sensor, a wind sensor (one example of which is described in U.S. Pat. No. 10,150,551), a vessel speed sensor, or the like.

The sonar transducer 56 may be housed in the lower unit of the third propulsion unit 16 (e.g., trolling motor lower unit), attached to the marine vessel 10 or, in some cases, may be castable or otherwise remote. The sonar transducer 56 may be configured to gather sonar return signals, e.g. sonar returns, from the underwater environment relative to the marine vessel 10. Accordingly, the processor 42 may be configured to receive the sonar return data from the sonar transducer 56, process the sonar return data to generate an image including a sonar image based on the gathered sonar return data. From this information, the processor 42 is configured to determine if the bed of the body of water is rocky, silty, or sandy. In some embodiments, the processor 42 may be configured to determine depth and bottom contours, detect fish, locate wreckage, detect vegetation, etc. In this regard, sonar beams or pulses from a sonar transducer 56 can be transmitted into the underwater environment. The sonar signals reflect off objects in the underwater environment (e.g., fish, structures, sea floor bottom, etc.) and return to the transducer assembly, which converts the sonar returns into sonar return data that can be used to produce a sonar image of the underwater environment on the display 48.

Figure 3:
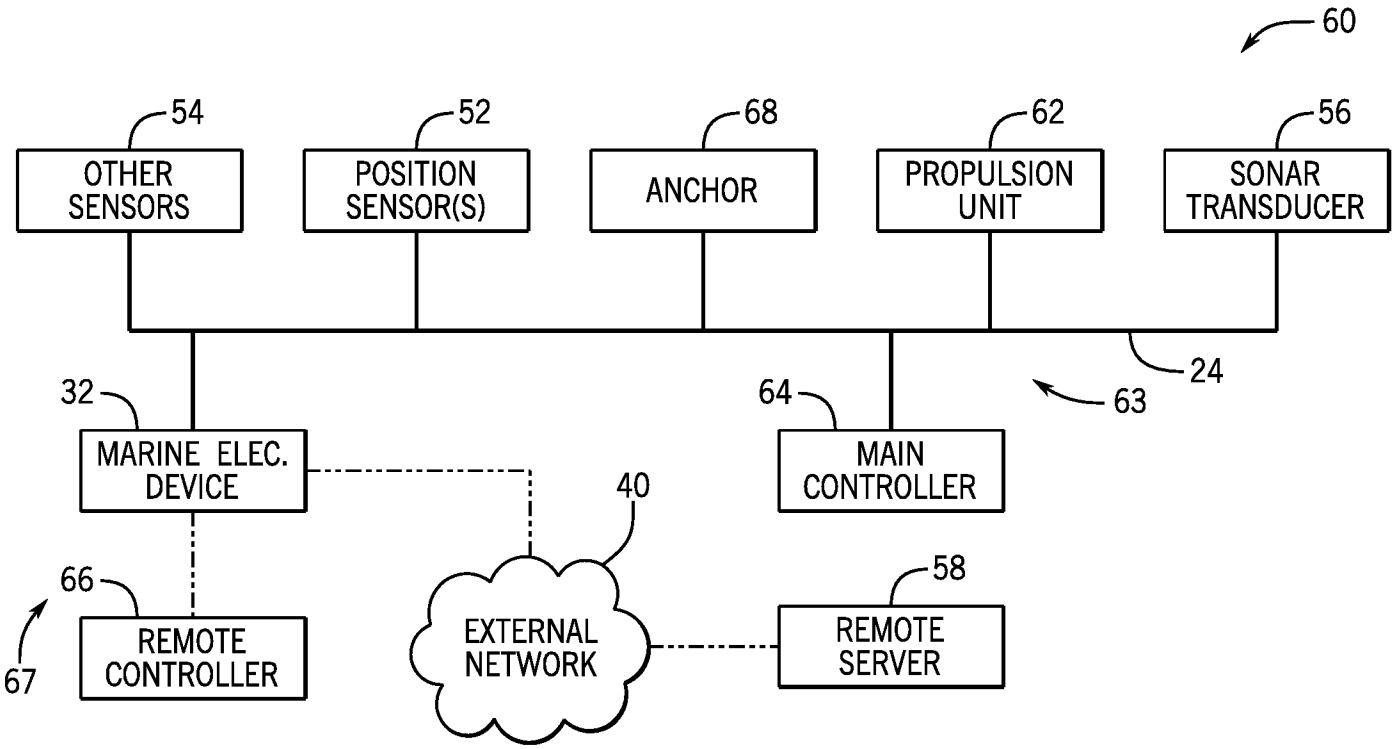
FIG. 3 is a block diagram of an example of an anchoring system for the marine vessel.

FIG. 3 is a block diagram of an anchoring system 60 for the marine vessel 10. Many of the components, such as the marine electronic device 32, position sensor(s) 52, sonar transducer 56, external network 40, and remote server 58 have already been described hereinabove and will not be described again. Examples of the propulsion unit 62 are the first and/or second and/or third propulsion unit 12, 14, 16 described hereinabove, although the propulsion unit could instead be a set of rotatable thrusters coupled to the marine vessel 10. One example of the main controller 64 is the controller 22 described hereinabove, although the main controller 64 could instead be a sub-controller of the controller 22 or a controller specifically associated with one of the propulsion units 12, 14, 16. A remote controller 66 wirelessly communicates with the marine electronic device 32 and is one example of a user interface 46 (and possibly one example of a display 48) as described with respect to FIG. 2. The system 60 further includes a power-deployable anchor 68, which is described below. These devices may all be connected via the CAN bus 24, or alternatively some or all of the devices may be wirelessly connected.

Figure 4:
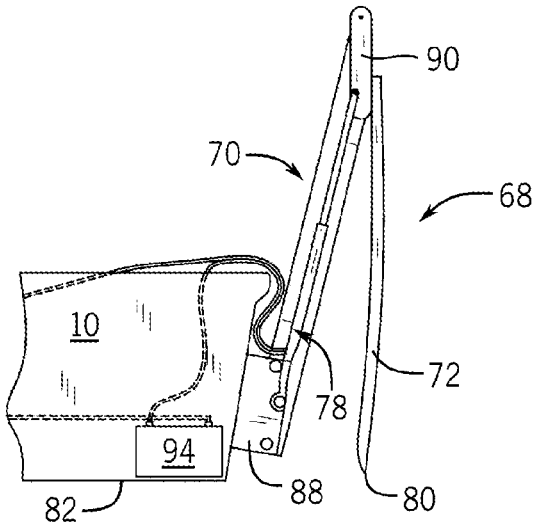
FIG. 4 illustrates one example of a power-deployable anchor in a retracted position.
Figure 5:
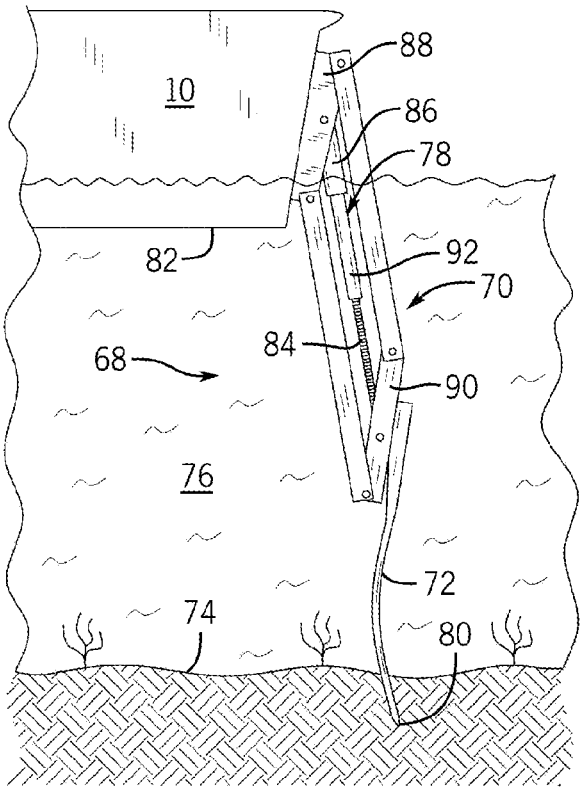
FIG. 5 illustrates the power-deployable anchor in a deployed position.

The power-deployable anchor 68 generally includes an actuator and an anchoring portion, the actuator being configured to deploy the anchoring portion into the bed of the body of water. FIGS. 4 and 5 show one example of such a power-deployable anchor 68. The power-deployable anchor 68 includes an upper arm 70 and a lower arm 72 (one example of the anchoring portion) adapted to be thrust into the bed 74 of a body of water 76 in which the marine vessel 10 is operating. An actuator 78 is configured to move the upper arm 70 between a raised position in which the lower end 80 of the lower arm 72 is preferably above the bottom 82 of the hull of the marine vessel 10 (as shown in FIG. 4) and a deployed position in which the lower end 80 of the lower arm 72 is thrust downwardly so as to engage the bed 74 of the body of water 76 (as shown in FIG. 5). To accomplish such movement, a motor 86 drives a lead screw 84 out from an internally threaded housing 92. Because the actuator 78 is connected between end plates 88, 90 at either end of the upper arm 70, changing the extent to which the lead screw 84 extends from the internally threaded housing 92 serves to move the upper arm 70 between its raised and its lowered positions. The actuator 78 is provided with power from a battery 94 on board the marine vessel 10. The actuator 78 is controlled by a controller (not shown) which may be provided with the motor 86, with the battery 94, or elsewhere on the marine vessel 10, such as within the housing of the marine electronic device 32. The anchor controller, regardless of its location, is communicatively coupled with the controller 43 of the marine electronic device 32 and/or the main controller 64 via the CAN bus 24.

One example of a power-deployable anchor 68 as shown in FIGS. 4 and 5 is the POWER-POLE™ sold by JL Marine Systems, Inc. of Tampa, Florida. Other power-deployable anchors, known as "shallow water anchors" in the industry, could instead be used. For example, in other examples, the actuator comprises an electric motor driving a hydraulic pump supplying fluid to a telescoping rod assembly instead of an electric linear actuator. In still other examples, different types of electric actuators could be used. The power-deployable anchor could have a different geometrical configuration, such as a retracting pole that deploys only in the vertical direction, instead of the parallelepiped arrangement shown herein that results in a somewhat arcing motion of the device. Further, the power-deployable anchor 68 need not be a shallow water anchor, but could be a more traditional anchor, which is attached to a rope or chain that is in turn wound around a windlass. The windlass has an actuator comprising a power-driven (e.g., motor-driven) storage cylinder, as is known, which is rotated to deploy the anchoring portion by unwinding the rope or chain, and to pull the anchoring portion out of the water by winding the rope or chain back around the storage cylinder. Further types of power-deployable anchors are known in the art and are contemplated herein. Typically, an operator will use two anchors, which can be the same type of different types, to moor a marine vessel to the bed of the body of water in order to limit both translational and rotational movement of the marine vessel.

Returning to FIG. 3, those having ordinary skill in the art are also familiar with electronic anchoring systems, in which the marine vessel is held at a target location, and optionally at a target orientation, by way of a feedback control system that causes the propulsion unit 62 to produce thrust automatically when required to minimize or eliminate any positional (and optionally rotational) error. Such systems/features are often referred to as station-keeping, spot-locking, or virtual anchoring systems. The target location at which the marine vessel 10 is held may be a global location with respect to Earth's coordinate system or a relative location with respect to an object proximate the marine vessel 10. The target orientation may be a compass heading or a relative bearing with respect to an object proximate the marine vessel 10. The position sensor(s) 52 and optionally other sensors 54 provide information as to the actual location and the actual orientation of the marine vessel 10 to the main controller 64. Through use of a feedback control algorithm, such as a proportional, integral, derivative (PID) control algorithm, the main controller 64, or a sub-controller thereof, is configured to determine marine vessel movements that will minimize a difference between the actual location and the target location of the marine vessel 10, and optionally that will minimize a difference between the target orientation and the actual orientation of the marine vessel 10. The main controller 64 then outputs commands to actuators that control the direction and magnitude of thrust of the propulsion unit 62 (including, but not limited to, steering actuators, trim actuators, throttle plate actuators, motors, and shift actuators), which thrust causes the marine vessel movements determined by the controller 64. The sensors 52, 54 continually determine if the marine vessel 10 has moved from the target location (and optionally if the marine vessel has rotated from the target orientation) such that any corrections required are generally very small. Electronic anchoring is generally well known, and one example of a system and method for electronic anchoring using two marine propulsion units located at the stern of a marine vessel is described in more detail in U.S. Pat. No. 7,305,928. Examples of systems and methods for electronic anchoring using a trolling motor are described in U.S. Pat. Nos. 5,491,636 and 6,678,589.

Thus the electronic anchoring system 63 comprises at least the main controller 64 and the propulsion unit 62, but also optionally comprises the position sensor(s) 52 and other sensors 54. In one example, the electronic anchoring system 63 comprises a sensor (e.g., position sensor 52, other sensors 54) configured to determine an actual location of the marine vessel 10, and a controller (e.g., main controller 64 or a sub-controller thereof) configured to determine marine vessel movements that will minimize a difference between the actual location of the marine vessel 10 and the target location of the marine vessel 10. The controller is configured to control the thrust of the propulsion unit 62 to carry out the determined marine vessel movements.

The electronic anchoring system 63 can be activated in many ways. In one example, the user can select a dedicated button located at the operation console 20 or on a remote controller 66 to activate the electronic anchoring system 63. In another example, the user can navigate to and select a soft key that is part of the user interface 46 of the marine electronic device 32 to activate the electronic anchoring system 63. The user can select to electronically anchor at the current location of the marine vessel 10 or at a predetermined location stored in the memory 44 of the marine electronic device 32. In the latter instance, the controller 64 will first command the propulsion unit 62 to navigate the marine vessel 10 to the target location before entering a location-hold routine.

Those skilled in the art will realize that sometimes a user uses the electronic anchoring system 63 to maintain the marine vessel 10 in place in the body of water 76, and at other times uses one or more power-deployable anchors 68 to maintain the marine vessel 10 in place in the body of water 76. The present inventors have realized that under certain sets of conditions, such as weather conditions, water depth conditions, water bed conditions, current conditions, and/or vessel speed conditions, using one or the other of the electronic anchoring system 63 or the power-deployable anchor 68 (or both together) will have better results, and that an operator is not necessarily always aware of such conditions (or does not have time to consider such conditions) before selecting between the methods of anchoring. Thus, the present inventors have developed a system and algorithms in which a controller determines whether to use the electronic anchoring system 63, the power-deployable anchor 68, or both the electronic anchoring system 63 and the power-deployable anchor 68 together, upon selection of a single anchoring request input by the user. This removes the guesswork from deciding which type of anchoring will work better under given conditions and has other benefits (such as environmental and/or economic) that will be described herein below.

Referring still to FIG. 3, a system 60 for a marine vessel 10 comprises a power-deployable anchor 68 that, when deployed, is configured to contact a bed 74 of a body of water 76 in which the marine vessel 10 is located. The system 60 includes an electronic anchoring system 63 comprising a propulsion unit 62 configured to produce thrust automatically when required to maintain the marine vessel 10 at a target location in the body of water 76. The system 60 also includes a user input device 67, such as the remote controller 66 and/or buttons and/or soft keys on the marine electronic device 32. A controller is provided in signal communication with the user input device 67, the power-deployable anchor 68, and the electronic anchoring system 63. In a particular example, the controller is the controller 43 of the marine electronic device 32, and the memory 44 stores an anchoring selection module for execution by the processor 42 in response to a user input, as will be described herein below. In another example, the controller is the main controller 64 or a sub-controller thereof, a controller located in the propulsion unit 62, or an additional controller dedicated to carrying out the anchoring selection algorithm. According to the present disclosure, the controller is configured to deploy the power-deployable anchor 68 to moor the marine vessel to the bed 74 of the body of water 76 in response to a single user-selected option input via the user input device 67 under a first set of conditions. The controller is also configured to activate the electronic anchoring system 63 to maintain the marine vessel 10 at the target location in the body of water 76 in response to the single user-selected option input via the user input device 67 under a different second set of conditions. Further, the controller is configured to activate the electronic anchoring system 63 and to deploy the power-deployable anchor 68 in response to the single user-selected option input via the user input device under a different third set of conditions. Thus, the very same single user-selected option can result in either (a) deploying of the power-deployable anchor 68, or (b) activation of the electronic anchoring system 63, or (c) both deploying of the power-deployable anchor 68 and activation of the electronic anchoring system 63 at the same time.

Figure 6:
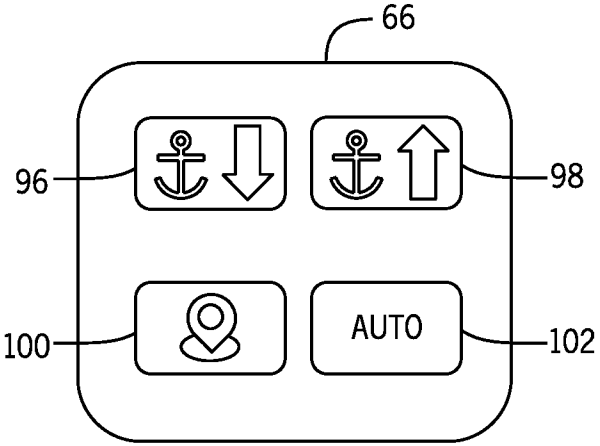
FIG. 6 illustrates a remote controller for the marine anchoring system.

FIG. 6 shows one example of the remote controller 66, which is communicatively connected to the marine electronic device 32 by way of a transmitter or transceiver compatible with the communication interface 50. The remote controller 66 may be battery powered and is configured similarly to known remote controller devices for marine propulsion units such as trolling motors. The remote controller 66 has four user-selectable buttons or keys: an anchor down button 96, an anchor up button 98, an electronic anchoring button 100, and an "auto" button 102. Selection of the anchor down button 96 commands the power-deployable anchor 68 to deploy such that its lower end 80 engages the bed 74 of the body of water 76 if the water is shallow enough, as described hereinabove with respect to FIG. 5. Selection of the anchor up button 98 pulls the lower end 80 of the power-deployable anchor 68 up to the position shown in FIG. 4. Of course, if a different type of anchor is used, selection of the buttons 96, 98 results in deploying or retracting of that different type of anchor. Selection of the electronic anchoring button 100 activates the electronic anchoring system 63 to maintain the marine vessel 10 at a target location equal to the location of the marine vessel 10 upon actuation of the button 100. Selection of the "auto" button 102 activates the anchoring selection algorithm described herein. Thus, not only is the remote controller 66 configured to accept the single user-selected option that activates the anchoring selection algorithm, the user input device (here, remote controller 66) is configured to accept further user-selectable options that allow the user to choose to deploy the power-deployable anchor 68 (via button 96) or to activate the electronic anchoring system 63 (via button 100). This allows the user to choose whether the anchoring selection algorithm is used or not.

Figure 7:
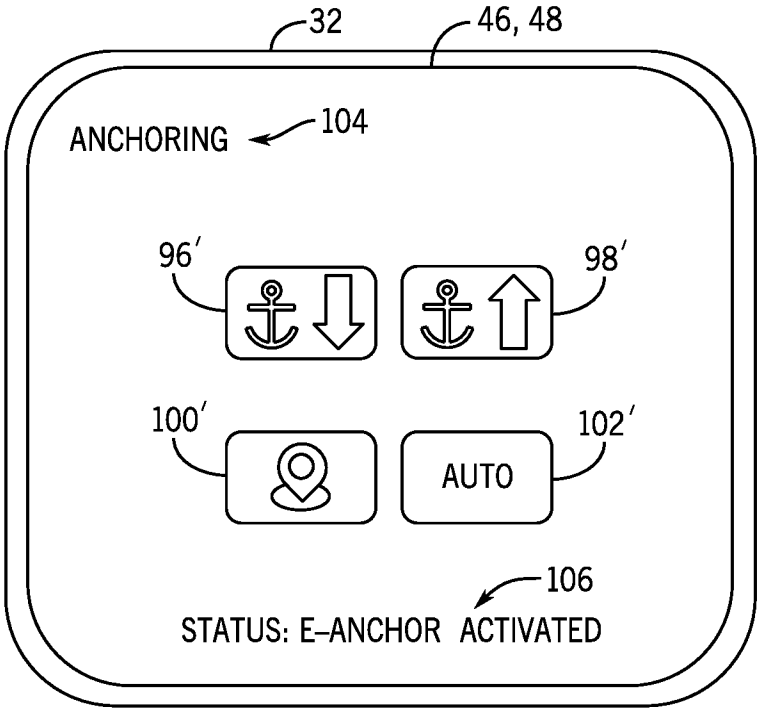
FIG. 7 illustrates an example screen display of the marine electronic device.

FIG. 7 illustrates the marine electronic device 32 in an instance in which it comprises a touchscreen, and thus the display 48 is also the user interface 46. The display 48 is configured to render four soft keys, 96', 98', 100', 102', selection of which has the same results as those described with respect to buttons 96, 98, 100, 102, respectively, in FIG. 6. The display 48 is further configured to render text 104 showing the current sub-screen that is being displayed (here, "anchoring"), which the user can navigate to by appropriate selections on prior screens. The display 48 is also configured to render text 106 indicating which type of anchoring is currently being used. For example, the text 106 in FIG. 7 indicates that the electronic anchoring system 63 is being used to maintain the marine vessel 10 in place. Appropriate text could likewise be used to indicate that the power-deployable anchor 68 is deployed or that both types of anchoring are in use.

Those having ordinary skill in the art will realize that the user-selectable input can be provided for on devices other than the remote controller 66 and/or the marine electronic device 32, such as on the head or base of a trolling motor, on a trolling motor foot pedal, or via an application running on the user's smart device. Further, the user-selectable input can be available on more than one user input device and in more than one location.

Further, those having ordinary skill in the art will understand that when the power-deployable anchor 68 is deployed, this may mean that one, two, or more power-deployable anchors are deployed simultaneously, if the marine vessel is equipped with same.

The first, second, and third sets of conditions under which the controller selects to use one type of anchoring or the other or both may vary, and several non-limiting examples are described herein below.

In one example, at least one of the first, second, and third sets of conditions includes information related to a location of the marine vessel 10 with respect to Earth's geographical coordinate system and/or information related to a location of the marine vessel 10 with respect to an object proximate to the marine vessel 10. The former can be determined by a GPS receiver, and the latter by proximity sensors, (both of which are examples of position sensor 52) as is known. For example, if such information indicates that the marine vessel 10 is near a dock, the controller may choose to use the power-deployable anchor 68 only, so that the operator does not need to tie the marine vessel 10 to the dock when leaving the marine vessel 10 behind.

In another example, at least one of the first, second, and third sets of conditions includes information related to the bed 74 of the body of water 76 in which the marine vessel 10 is located. For example, the marine electronic device 32 may have stored in its memory 44 or may retrieve from the remote server 58 information from a nautical chart that indicates the bed 74 is rocky, sandy, or silty. To do this, the processor 42 may determine a location, e.g. a geographical location, based on the location data from the position sensor 52 and correlate the geographical location with a corresponding chart location in the nautical chart. Additionally or alternatively, the marine electronic device 32 may interpret information from the sonar transducer 56 to determine that the bed 74 is rocky, sandy, or silty. In one example, the controller selects to use the power-deployable anchor 68 when in shallow water and the bed 74 is sandy, so as to avoid spraying sand in the water, as might otherwise occur if the propulsion unit 62's propeller were to be actuated to full speed to provide for a quick stop.

Thus, it has already been alluded to that at least one of the first, second, and third sets of conditions includes information related to a depth of the body of water 76. The water depth can similarly be determined from a bathymetric chart stored in the memory 44 of the marine electronic device 32 or accessed from the remote server 58. Such chart-based bathymetric data may be sufficient when the marine vessel 10 is operating in relatively deep water, where water level is not likely to change significantly from season to season or year to year. In other instances, such as in shallower water, the water depth may be obtained from the sonar transducer 56 (as part of a sonar depth-finder). The controller may select to use the power-deployable anchor 68 when the bed 74 is rocky and the marine vessel 10 is in water shallow enough for the power-deployable anchor 68 to reach the bed 74. Alternatively, the controller may select to use the electronic anchoring system 63 when the bed 74 is silty and the water is shallow, as the power-deployable anchor 68 may not have much effect in a silty bottom. Further, if more than one type of power-deployable anchor 68 is provided on the marine vessel 10, the controller can be configured to determine which type of power deployable anchor to deploy based on the depth information. For example, in deeper water the controller may choose to deploy a traditional anchor, while in shallower water the controller may choose to deploy a shallow water anchor. The controller can make this determination by comparing a stored length/reach of the power-deployable anchor 68 with a depth of the water in which the marine vessel 10 is operating.

Further, the controller can use both location data and information related to the bed 74 together to determine which method of anchoring to use. For example, if the location information indicates that the marine vessel 10 is operating in a protected area (such as near a coral reef or near other protected underwater vegetation) and that there is indeed vegetation below the marine vessel 10 as determined by information from the sonar transducer 56, the controller may select to use the electronic anchoring system 63 in order to leave the least environmental impact.

In yet another example, at least one of the first, second, and third sets of conditions includes information related to a speed of the marine vessel 10 upon receipt of the single user-selected option to anchor the marine vessel 10. Vessel speed can be determined by information from a GPS receiver (position sensor 52) or from a pitot tube, paddle wheel, or other known device (other sensors 54). If the marine vessel 10 is traveling above a predetermined threshold speed (which can be calibrated or user-programmed) when the user-selected input is received, the controller may select to use both the power-deployable anchor 68 and the electronic anchoring system 63 together. The added physical anchoring may eliminate the "hunting" the electronic anchoring feedback controller might otherwise engage in if it first overcompensates to counteract the high vessel speed. The controller might choose to use both types of anchoring only if the water depth data indicates that the power-deployable anchor 68 will be able to reach the bed 74. On the other hand, the controller may choose to use only the power-deployable anchor 68 if the vessel speed is below the threshold speed and other conditions do not indicate that it is beneficial to use the electronic anchoring system 63.

In other examples, at least one of the first, second, and third sets of conditions includes information related to at least one of wind, current, and weather conditions acting on the marine vessel 10. Such information can be provided by the other sensors 54 on the marine vessel and/or retrieved from a remote server 58. If conditions are rough, the controller may choose to use the power-deployable anchor 68 in order to save battery life or fuel required to continually run the propulsion unit 62 to counter the force of wind, waves, or current tending to move the marine vessel 10 from the target location.

Still other conditions detectable by the devices on the marine vessel 10 can be used by the controller to select a type of anchoring. For example, if the sonar transducer 56 detects that there is a weed line or a bank ahead of the marine vessel 10, the controller may select to use both types of anchoring to stop the marine vessel 10 as quickly as possible.

Note that a set of conditions can include a unit set (i.e., one condition), or two, three, or more conditions. The conditions can be determined from multiple types of sensors and/or different conditions can be determined from the same sensor. The above sets of conditions are only examples and those having ordinary skill in the art would understand that various different combinations/sets of conditions could be used as inputs to the controller's anchor-selection algorithm.

In one particular example, the controller is part of a fishfinder and/or chartplotter provided on the marine vessel 10. The fishfinder and/or chartplotter are specific examples of the marine electronic device 32, which may have fish-finding capabilities, chartplotting capabilities, or both fish-finding and chartplotting capabilities. In such an example, the system 60 further comprises a global positioning system (GPS) receiver (as one example of the position sensor 52) providing information related at least one of the first, second, and third sets of conditions to the fishfinder and/or chartplotter, and a sonar depth finder (comprising the sonar transducer 56) providing information related at least one of the first, second, and third sets of conditions to the fishfinder and/or chartplotter.

Thus, in one particular example, a system 60 for a marine vessel 10 comprises a power-deployable anchor 68 that, when deployed, is configured to contact a bed 74 of a body of water 76 in which the marine vessel 10 is located. The system 60 includes an electronic anchoring system 63 comprising a propulsion unit 62 configured to produce thrust automatically when required to maintain the marine vessel 10 at a target location in the body of water. The system 60 also includes a global positioning system (GPS) receiver (as one example of the position sensor 52) and a sonar depth finder (comprising the sonar transducer 56). A fishfinder and/or chartplotter (as one example of the marine electronic device 32) is communicatively coupled to the power-deployable anchor 68, the electronic anchoring system 63, the GPS receiver, and the sonar depth finder. Given a first set of information from the GPS receiver and/or the sonar depth finder, the fishfinder and/or chartplotter is configured to deploy the power-deployable anchor 68 to moor the marine vessel 10 to the bed 74 of the body of water 76 in response to a command to maintain the marine vessel 10 in place in the body of water. Given a different second set of information from the GPS receiver and/or the sonar depth finder, the fishfinder and/or chartplotter is configured to activate the electronic anchoring system 63 to maintain the marine vessel 10 at the target location in the body of water 76 in response to the command to maintain the marine vessel 10 in place in the body of water. Given a different third set of information from the GPS receiver and the sonar depth finder, the fishfinder and/or chartplotter is configured to activate the electronic anchoring system 63 and to deploy the power-deployable anchor 68 in response to the command to maintain the marine vessel 10 in place in the body of water.

More generally, a system 60 for maintaining a marine vessel 10 in place in a body of water 76 comprises a controller (e.g., 43 or 64 or another controller) in signal communication with a power-deployable anchor 68 and a propulsion-based electronic anchoring system 63. A user input device (e.g., remote controller 66, marine electronic device 32, or other input device at the operation console 20) is in signal communication with the controller. The controller is configured to deploy the power-deployable anchor 68 in response to a single user-selected option input via the user input device under a first set of conditions. The controller is configured to activate the propulsion-based electronic anchoring system 63 in response to the single user-selected option input via the user input device under a different second set of conditions. The controller is configured to activate the electronic anchoring system 63 and to deploy the power-deployable anchor 68 in response to the single user-selected option input via the user input device under a different third set of conditions.

At least one of the first, second, and third sets of conditions includes at least one of the following: information related to a location of the marine vessel with respect to Earth's geographical coordinate system; information related to a location of the marine vessel with respect to an object proximate to the marine vessel; information related to the bed of the body of water; information related to a depth of the body of water; information related to at least one of wind, current, and weather conditions acting on the marine vessel; and information related to a speed of the marine vessel upon receipt of the single user-selected option.

In one example, the electronic anchoring system comprises: a sensor configured to determine an actual location of the marine vessel; an additional controller configured to determine marine vessel movements that will minimize a difference between the actual location of the marine vessel and the target location of the marine vessel; and a propulsion unit configured to produce thrust. The additional controller is configured to control the thrust of the propulsion unit to carry out the determined marine vessel movements.

In one example, the power-deployable anchor comprises an actuator and an anchoring portion, the actuator being configured to deploy the anchoring portion into a bed of the body of water.

In the above description, certain terms have been used for brevity, clarity, and understanding. No unnecessary limitations are to be inferred therefrom beyond the requirement of the prior art because such terms are used for descriptive purposes and are intended to be broadly construed. The order of method steps or decisions shown in the Figures and described herein are not limiting on the appended claims unless logic would dictate otherwise. It should be understood that the decisions and steps can be undertaken in any logical order and/or simultaneously. The different systems and methods described herein may be used alone or in combination with other systems and methods. It is to be expected that various equivalents, alternatives and modifications are possible within the scope of the appended claims.

What is claimed is:

1. A system for a marine vessel comprising:

a power-deployable anchor that, when deployed, is configured to contact a bed of a body of water in which the marine vessel is located;

an electronic anchoring system comprising a propulsion unit configured to produce thrust automatically when required to maintain the marine vessel at a target location in the body of water;

a user input device; and a controller in signal communication with the user input device, the power-deployable anchor, and the electronic anchoring system;

wherein in response to a single user-selected option input via the user input device, the controller is configured to;

deploy the power-deployable anchor to moor the marine vessel to the bed of the body of water under a first set of conditions; and activate the electronic anchoring system to maintain the marine vessel at the target location in the body of water under a different second set of conditions.

2. The system of claim 1, wherein in response to the single user-selected option input via the user input device, the controller is configured to activate the electronic anchoring system and to deploy the power-deployable anchor under a different third set of conditions.

3. The system of claim 1, wherein at least one of the first and second sets of conditions includes information related to a location of the marine vessel with respect to Earth's geographical coordinate system and/or information related to a location of the marine vessel with respect to an object proximate to the marine vessel.

4. The system of claim 1, wherein at least one of the first and second sets of conditions includes information related to the bed of the body of water.

5. The system of claim 1, wherein at least one of the first and second sets of conditions includes information related to a depth of the body of water.

6. The system of claim 1, wherein at least one of the first and second sets of conditions includes information related to at least one of wind, current, and weather conditions acting on the marine vessel.

7. The system of claim 1, wherein at least one of the first and second sets of conditions includes information related to a speed of the marine vessel upon receipt of the single user-selected option.

8. The system of claim 1, wherein the user input device is configured to accept further user-selectable options that allow the user to choose to deploy the power-deployable anchor or to activate the electronic anchoring system.

9. The system of claim 1, wherein the electronic anchoring system comprises:

a sensor configured to determine an actual location of the marine vessel; and an additional controller configured to determine marine vessel movements that will minimize a difference between the actual location of the marine vessel and the target location of the marine vessel;

wherein the additional controller is configured to control the thrust of the propulsion unit to carry out the determined marine vessel movements.

10. The system of claim 1, wherein the power-deployable anchor comprises an actuator and an anchoring portion, the actuator being configured to deploy the anchoring portion into the bed of the body of water.

11. The system of claim 1, wherein the controller is part of a fishfinder and/or chartplotter provided on the marine vessel, and the system further comprises:

a position sensor providing information related to at least one of the first and second sets of conditions to the fishfinder and/or chartplotter; and a sonar transducer providing information related to at least one of the first and second sets of conditions to the fishfinder and/or chartplotter.

12. A system for maintaining a marine vessel in place in a body of water, the system comprising:

a controller in signal communication with a power-deployable anchor and a propulsion-based electronic anchoring system; and a user input device in signal communication with the controller;

wherein in response to a single user-selected option input via the user input device, the controller is configured to deploy the power-deployable anchor under a first set of conditions; and wherein in response to the same single user-selected option input via the user input device, the controller is configured to activate the propulsion-based electronic anchoring system under a different second set of conditions.

13. The system of claim 12, wherein in response to the same single user-selected option input via the user input device, the controller is configured to activate the electronic anchoring system and to deploy the power-deployable anchor under a different third set of conditions.

14. The system of claim 13, wherein at least one of the first, second, and third sets of conditions includes at least one of the following:

information related to a location of the marine vessel with respect to Earth's geographical coordinate system;

information related to a location of the marine vessel with respect to an object proximate to the marine vessel;

information related to a bed of the body of water;

information related to a depth of the body of water;

information related to at least one of wind, current, and weather conditions acting on the marine vessel; and information related to a speed of the marine vessel upon receipt of the single user-selected option.

15. The system of claim 12, wherein at least one of the first and second sets of conditions includes at least one of the following:

information related to a location of the marine vessel with respect to Earth's geographical coordinate system;

information related to a location of the marine vessel with respect to an object proximate to the marine vessel;

information related to a bed of the body of water;

information related to a depth of the body of water;

information related to at least one of wind, current, and weather conditions acting on the marine vessel; and information related to a speed of the marine vessel upon receipt of the single user-selected option.

16. The system of claim 12, wherein the electronic anchoring system comprises:

a sensor configured to determine an actual location of the marine vessel;

an additional controller configured to determine marine vessel movements that will minimize a difference between the actual location of the marine vessel and a target location of the marine vessel; and a propulsion unit configured to produce thrust;

wherein the additional controller is configured to control the thrust of the propulsion unit to carry out the determined marine vessel movements.

17. The system of claim 12, wherein the power-deployable anchor comprises an actuator and an anchoring portion, the actuator being configured to deploy the anchoring portion into a bed of the body of water.

18. The system of claim 12, wherein the controller is part of a fishfinder and/or chartplotter provided on the marine vessel, and the system further comprises:

a position sensor providing information related to at least one of the first and second sets of conditions to the fishfinder and/or chartplotter; and a sonar transducer providing information related to at least one of the first and second sets of conditions to the fishfinder and/or chartplotter.

19. A system for a marine vessel comprising:

a power-deployable anchor that, when deployed, is configured to contact a bed of a body of water in which the marine vessel is located;

an electronic anchoring system comprising a propulsion unit configured to produce thrust automatically when required to maintain the marine vessel at a target location in the body of water;

a global positioning system (GPS) receiver;

a sonar depth finder;

a fishfinder and/or chartplotter communicatively coupled to the power-deployable anchor, the electronic anchoring system, the GPS receiver, and the sonar depth finder;

wherein, given a first set of information from the GPS receiver and/or the sonar depth finder, the fishfinder and/or chartplotter is configured to deploy the power-deployable anchor to moor the marine vessel to the bed of the body of water in response to a single command to maintain the marine vessel in place in the body of water; and wherein, given a different second set of information from the GPS receiver and/or the sonar depth finder, the fishfinder and/or chartplotter is configured to activate the electronic anchoring system to maintain the marine vessel at the target location in the body of water in response to the same single command to maintain the marine vessel in place in the body of water.

20. The system of claim 19, wherein, given a different third set of information from the GPS receiver and/or the sonar depth finder, the fishfinder and/or chartplotter is configured to activate the electronic anchoring system and to deploy the power-deployable anchor in response to the same single command to maintain the marine vessel in place in the body of water.

* * * * *